United States Patent [19]

Baum

[11] Patent Number: 4,598,508

[45] Date of Patent: Jul. 8, 1986

[54] DEVICE FOR SECURING BUILDING SHAFTS AGAINST FORCIBLE ENTRY OR PASSAGE

[76] Inventor: Albert Baum, Osterreicher Str. 10, 8572 Goldbach, Fed. Rep. of Germany

[21] Appl. No.: 551,864

[22] Filed: Nov. 15, 1983

[51] Int. Cl.[4] ..... E06B 3/68

[52] U.S. Cl. ..... 52/106; 52/727; 49/57; 292/259 R

[58] Field of Search ..... 52/106, 727, 663–669; 109/49.5; 49/57, 51–56; 285/317; 292/150, 259

[56] References Cited

U.S. PATENT DOCUMENTS

| | | | |
|---|---|---|---|
| 389,335 | 9/1888 | Spear | 285/317 X |
| 391,879 | 10/1888 | Butler | 52/727 |
| 679,028 | 7/1901 | Larmore | 49/50 X |
| 1,803,272 | 4/1931 | Greenley | 52/106 X |
| 2,125,807 | 8/1938 | Petty . | |
| 2,156,579 | 5/1939 | Bayon | 52/106 X |
| 2,156,748 | 5/1939 | Walker | 49/57 X |
| 2,195,291 | 3/1940 | Zukor | 52/106 X |
| 2,292,954 | 8/1942 | Martin . | |
| 2,722,722 | 11/1955 | Mussman | 49/57 X |
| 3,507,229 | 4/1970 | MacDonald | 52/106 X |
| 4,374,598 | 2/1983 | Scott | 292/259 |
| 4,395,861 | 8/1983 | Fipke et al. | 52/106 X |
| 4,400,911 | 8/1983 | Bell et al. | 49/57 X |

FOREIGN PATENT DOCUMENTS 8225874 3/1983 Fed. Rep. of Germany .

*Primary Examiner*—John E. Murtagh
*Assistant Examiner*—Richard E. Chilcot, Jr.

[57] ABSTRACT

A device for securing the shafts of buildings, for example light shafts, against forcible intrusion or passage. The device includes at least one hollow blocking bar which spans the shaft transversely and the two ends of which are held in respective anchor members attached to the wall of the shaft with covered bolts and which contains a hollow security rod of substantially the same length. The blocking bar has the form of a polygonal prism the ends of which are received in form-fitting manner in respective recesses of associated respective attachment bases in such a way that they lie in opposing alignment to the mounting bolts of the base and are secured against pull-out by a latch member lock. The device is especially distinguished in that it offers a maximum of security against forcible intrusion while requiring a very small amount of technical and installation effort, by, firstly, giving access to the mounting bolts only after all of the blocking bars have been removed and, secondly, in that the shaping of the blocking bars contributes positively to maintaining the functional security of the components taking part in the anti-intrusion function as long as possible.

33 Claims, 19 Drawing Figures

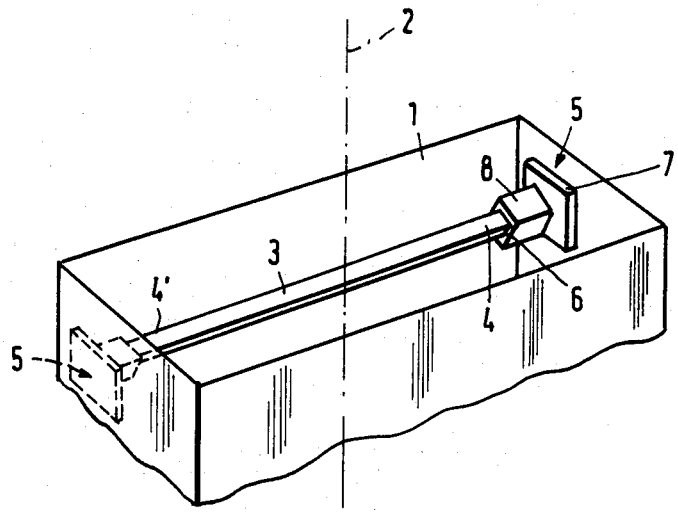
Fig. 1
Fig. 2
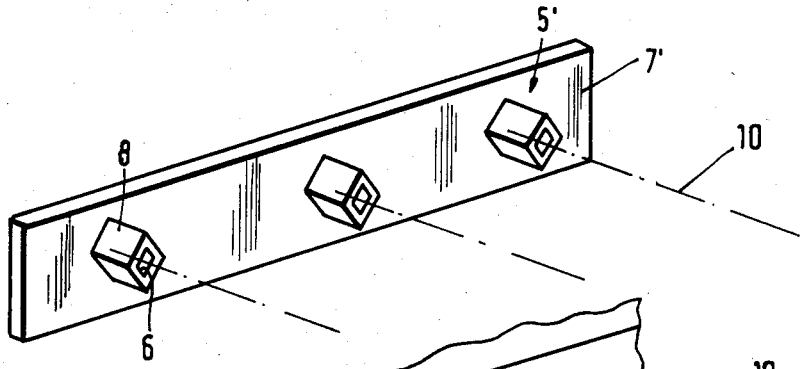
Fig. 2a
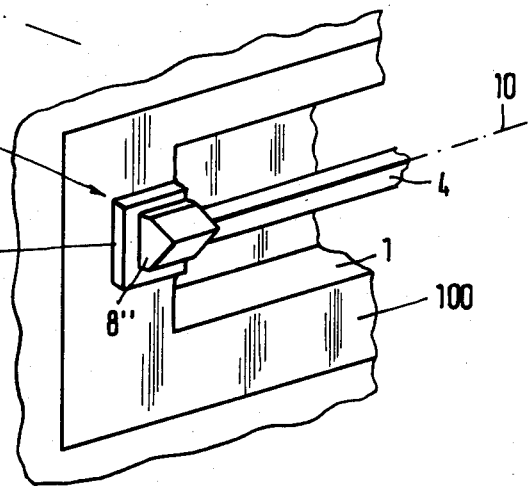

3
11
16
18
20
19
17
14
12
IV
VI
VII
$T_{20}$
$T_{17}$

DEVICE FOR SECURING BUILDING SHAFTS AGAINST FORCIBLE ENTRY OR PASSAGE

BACKGROUND OF THE INVENTION

1. Field of the Invention

The invention relates to the securing of building shafts, for example, light shafts, against forcible entry or passage. Such devices are installed, preferably retrofitted, in the light shafts of buildings that must be made especially secure, for example banks or prisons. The requirements for such devices are, therefore, the following: they must be simple to install and their components must be well secured against any kind of burglary tool.

2. Description of the Prior Art

DE OS 2 932 205 teaches a device in which the anchoring member of the blocking bars is formed by a box-frame member which is attached to the wall of the light shaft with dowels and which has several passages for receiving the ends of the blocking bars. The blocking bars are formed from round pipes inside which resides an equally round security rod which is intended to rotate when the blocking bar is being sawed in order to prevent the further advance of the saw. However, in order to make possible the installation, especially the retro-fitting of this device in an existing light shaft, the box-profile member must be attached at points lying between the recesses or passages that receive the individual blocking bars. To permit the subsequent tightening of the attachment bolts in these regions between the blocking bars, openings must be made in the box profile member and these must be covered with caps after the installation.

This known device offers a low level of security against forcing because suitable bending and burglary tools can so deform the blocking bars that the internal security rod is jammed and can no longer rotate. In addition, this device has the substantial disadvantage that the attachment bolts of the box profile member can be very easily exposed, even if the inside of the box frame member has been filled with concrete.

SUMMARY OF THE INVENTION

It is, therefore, an object of the present invention to provide a device which offers simple installation and a maximum of security against forcible entry or passage.

According to the invention, a separate mounting base is provided for each of the blocking bars of the security device. Each of the bases uses a latch closure according to the invention to receive the blocking bars in such a way that they completely cover the attachment bolt. Thus, the attachment bolts can no longer be exposed, making the device substantially more secure. Nevertheless, the installation of the security device is especially simple because the individual mounting bases or sockets can be securely attached before the respective blocking bars are inserted therein. Either the end faces or the outside surfaces near the ends of the blocking bars are then located opposite the attachment bolts. As the overall security of a security system is defined by the actual resistance to forcing of its weakest link, the further feature of the invention serves to so form the blocking bars that they are reliably protected against the use of even powerful mechanical or thermal burglary tools. To this end, the blocking bars are embodied as bars with a polygonal crossection and are preferably so mounted that the resistance to deformation of the crossection of the bar is particularly high in those directions which are especially relevant when any kind of powerful levered tool is used during an attempt at forcible defeat of the device and the bar is subjected to resulting stresses. For example, a blocking bar formed by a hollow profile tube having a square crossection is installed in a vertical light shaft such that the exterior surfaces of the blocking bar form an angle of 45° with the vertical walls of the light shaft. In this way, the blocking bar can offer a high resistance to bending when a powerful tool, for example an automobile jack, is used to exert a horizontal force. The special shape of the bar according to the invention results in the particular advantage that the interior space of the blocking bar is only neglibly deformed when even great forces act on it so that the security rod within the blocking bar continues to fulfill its special function even when great force is being exerted.

In an embodiment of the invention a completely closed hollow space is created within the blocking bar, which is is especially advantageous if the building security device is being forced with the use of, for example, welding or metal cutting burners. When high temperatures are applied externally by the metal cutting burner, a relatively high pressure is built up within the blocking bar and causes the flame of the cutter to be blown back as the wall of the bar is penetrated. This occurrence hinders the severing of the blocking bars.

The embodiment adds another function to the closure device, namely the inclusion of the latch elements of the latch lock. This feature holds the structural expense to a low level.

The latch lock according to the invention has the special advantage that, on the one hand, it reliably secures the blocking bar against removal even if the latter is subjected to great tensile forces and, on the other hand, the steel pins can be pressed outwardly with great force even if only a small space is available for receiving the latch elements. As the compression spring lies entirely within the closure device, this further embodiment also insures that the compression spring does not reach the annealing temperature even when the edge regions of ends of the blocking bar are subjected to prolonged heating, so that the latch lock operates in fully reliable manner even after prolonged application of a cutting burner.

In another embodiment by shaping the interior of the blocking bars in the form of a polygonal prism, the resistance to bending of the base is reduced only slightly, and it is thereby ensured that guide spaces are created in the corner regions within which steel roller cores of relatively small diameter can be received. Because of the above-mentioned shape of the blocking bar, these guiding void spaces for the steel roller cores are very difficult to compress, so that a jamming of the steel roller cores is substantially impossible. Even if the blocking bar is drilled through or bent to a great extent, the flexibility of the steel rollers permits them to roll freely and easily in these void spaces when a cutting tool is applied externally and penetrates the blocking bar to make contact with the steel roller cores. A further severing of the blocking bars is thus not possible. For example, if a square crossection profile tube is used as blocking bar and a round tube as security rod, there are four guiding void spaces distributed uniformly around the circumference of the blocking bar so that it cannot be sawed through or severed from any side. The steel roller cores can be made of one piece without incurring the problem that they will jam in the guiding void spaces. By suitably shaping the crossection of the security rods, the crossection of the guiding void spaces within the blocking bar can be optimized to insure that no jamming gap is created. In this connection, for example, an embodiment of the hollow security rod as an octagonal hollow prism has particular advantages.

If the closure device of the blocking bar has a machined tip on the side facing the hollow security rod and if this tip does not overlap the security rod in the radial direction, then the steel roller rods can be guided on the machined tip and can be made longer than the hollow security rod with the result that the steel roller pins extend reliably into the recess of the attachment base in the fully assembled state. Thus, the entire externally accessible area of the blocking bar has no place at which a cutting on severing tool might be applied without encountering a steel roller core. Preferably, the machined tip of the closure device closes off the interior of the hollow rod so that the above-mentioned safety effect during an attack by a cutting burner is enhanced.

If the the external form of the attachment base is also polygonally prismatic, the result is a particularly rigid anchoring of the blocking bars which additionally contributes to the functional reliability of the security system. This shape also has advantages of manufacture if the form of the polygonal prism of the attachment base is adapted to the polygonal prism of the blocking bar.

In this way, it is possible to use the simplest structural elements, i.e., semi-finished materials available in commerce at low cost, such as profile tubes and steel plates, to weld together an attachment base having all of the afore-mentioned advantages.

According to a further embodiment the aperture plate, i.e., the inside surface of the aperture plate, is used as the contact surface for the outwardly pressed latch members. In that case, the expense of technical complexity is further reduced.

The embodiment of the attachment base as a cast part makes it possible to further increase the functional reliability and security of the apparatus against forcible entry or passage. This is done by providing for accumulations of material at pre-determined locations that do not interfere with the installation or the insertion of the blocking bars in the attachment base. These accumulations of material serve to receive additional security devices.

The length or height of the attachment base is preferably so chosen or adapted to the height of the mounting bolt or to the dimensions of the locking member that, after final assembly of the blocking bar, the hollow security rod still overlaps the attachment base in the axial direction. If, for example, a round security rod is freely rotatable in the blocking bar, then the round security rod is capable of providing reliable security against severing or sawing of the blocking bar in the entire region between the two attachment bases.

To provide further security for the attachment base, the latter may, according to the further embodiment, be provided with rod roller pins oriented parallel to the blocking bar and extending along the attachment base so far as to overlap the above-mentioned steel roller cores with their ends. This further embodiment is easily realized in manufacturing practice, especially because the bores in the attachment base for receiving the steel roller pins need not be made very deep because the steel roller cores in the blocking bar are longer anyway than the hollow security tube due to the special configuration of the closure device. The receiver bores for the steel roller pins which rotate freely when a saw or other severing tool is applied can be provided in an attachment base constructed by welding as well as in one constructed as a cast part. However, the embodiment as a casting has the particular advantage that it is possible to make simple accumulations of material in the corners of the polygonal recess to create blind bores which start at the anchoring foot of the attachment base and which serve to receive the steel roller pins. Because the bore starts at the anchoring foot, it may be closed off in water-tight manner after insertion of the steel roller pin by a plug member that does not have to be separately protected, after filling the bore with any suitable lubricant. This insures that the steel roller pin will rotate completely reliably and securely in the blind bore even after a prolonged operational time, whenever a saw or other severing tool hits it.

Of course, the form of the blocking bar can be varied within wide limits but it has been found to be especially advantageous to embody the blocking bar as a hollow profile tube with square inside and outside contours.

The hollow security rod can also have many different shapes but note should be taken of the fact that the embodiment as a polygonal prism rod results in very high security against forcing only if steel roller cores are provided additionally between the hollow security rod and the blocking bar.

To attain additional security for the anti-break-in system according to the invention, it is possible to take further steps which are the subject of further embodiment.

For example, another level of security can be attained by including a further steel core in the hollow security rod.

If a plastic core is enclosed, for example, in the hollow security rod, then it is possible to insure that, for example, a severing tool equipped with diamond teeth will become largely ineffective when it encounters this plastic rod in that the chip pockets of this tool fill up with the plastic. On the other hand, a suitable choice of the chemical composition of the plastic succeeds in creating special effects, for example, heavy smoke generation or explosion-like effects whenever a cutting burner, for example, is applied to the blocking bar, creating a severe impediment to the persons wanting to break in or out.

Of course, several telescoping prismatic tubes made of different materials can also be disposed in the blocking bar, made of different basic materials. This step additionally hinders the destruction of the blocking bar by means of a cutting burner, by exploiting the different reactions of the materials.

In order to exclude effects of contact corrosion when using different materials for the various prismatic rods or tubes, any surfaces of the various prismatic tubes that are in direct contact are coated with identical materials, e.g., zinc.

Another embodiment is especially advantageous because, in this way, it is possible to insure for a long time that the easy operation of the steel roller cores, the hollow security rod and the latch closure is maintained.

BRIEF DESCRIPTION OF THE DRAWING

A number of embodiments of the invention will now be explained in detail with the aid of schematic drawings, in which FIG. 1 is a perspective view as seen obliquely from the top of schematically drawn air or light shaft with an included blocking bar;

FIGS. 2, 2*a* are perspective view of further embodiments of attachment bases;

DETAILED DESCRIPTION OF THE PREFERRED EMBODIMENTS

Figures 3, 4, 5, 6, 7:
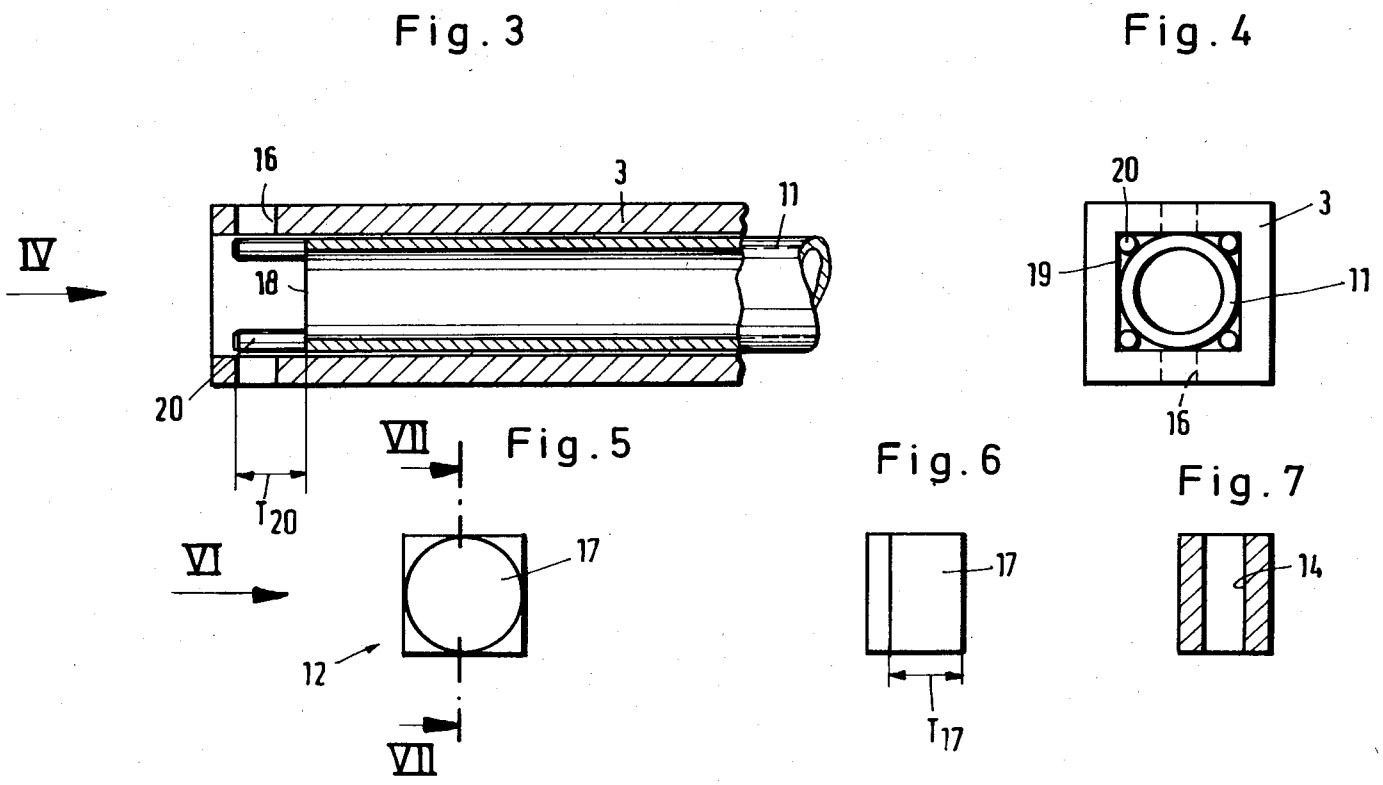
FIG. 3 is a partially sectional view of the end section of an embodiment of the blocking bar with an included hollow security rod and several steel roller cores. This figure shows the individual components in the relative positions that they occupy after final assembly.
FIG. 4 is a view of FIG. 3 as seen along the arrow IV.
FIG. 5 is a front view of the closure element to be inserted in the end section of the blocking bar of FIG. 3.
FIG. 6 is a side view of the closure element of FIG. 5 when viewed along the arrow VI.
FIG. 7 is a sectional view of the closure element of FIG. 5 when sectioned along the line VII—VII.

FIG. 1 is a schematic showing of an air shaft 1 to be protected against incursion, as found, for example, in prison buildings. In the embodiment shown, the axis 2 of the light shaft extends in the vertical direction. In a plane perpendicular to the axis 2 of the light shaft a hollow blocking bar 3 extends across and spanning the light shaft 1, its two ends 4 and 4′ being rigidly held in respective anchors 5. The anchor 5 is attached with covered bolts to the wall of the shaft and a separate mounting bolt is assigned to each of the blocking bars 3, as will be further explained in detail below.

The blocking bar has the form of a polygonal prism and, in the embodiment of FIG. 1, this blocking bar 3 is formed by a profile tube with square crossection. The ends 4 and 4′ of the blocking bar are held in form-fitting manner in a recess 6 (see also FIG. 2) provided in the anchor embodied as an attachment base 5. The attachment base 5 has a base plate 7 (or 7′ in FIG. 2) which is followed by a prismatic tube section 8 for receiving the end 4 or 4′ or the blocking bar. In this way, the ends 4 and 4′ are received in the attachment base 5 in form-fitting manner and are secured against pull-out by a latch lock to be explained in greater detail below. The latch lock has the advantage, among others, that the safety mechanisms within the attachment base 5 and/or the blocking bar 3 are not subjected to any kind of stresses during assembly.

The attachment bases 5 are mounted on the wall of the shaft in such way that the mounting bolts 9 (see FIG. 10) are positioned in the axial prolongation of the blocking bars 3 and are thus completely covered by the blocking bars 3.

As may be seen from the illustrations of FIGS. 1 and 2, the prismatic blocking bars 3 of square crossection are so disposed or received in the attachment bases 5 that, when external forces act parallel to the axis of the shaft or in a plane perpendicular to the axis 2 of the shaft, the resistance to bending of the blocking bar 3 is particularly high. This may also be seen from FIG. 2, in which the axes 10 of the blocking bars extend in the plane perpendicular to the axis 2 of the air shaft.

Preferably, the blocking bar 3 is formed from a zinc-coated and, if necessary, tempered steel tube made of very tough steel.

As may be seen from FIGS. 3 and 4, the interior of the blocking bar 3 holds a security rod or hollow prismatic rod 11 extending substantially over the entire length of the blocking bar 3 and the rod 11 is held in such way as to insure the free rotation thereof inside the blocking bar 3. Such free rotation is insured, for example, if the blocking bar, as shown in FIGS. 3 and 4, is embodied as a prismatic tube of square crossection and the hollow security rod 11 is a round tube. In that case, the ability of the hollow security rod 11 insures that it can co-rotate freely within the blocking bar 3 if a saw or other severing tool penetrates the blocking bar 3 from the outside and meets the hollow security rod. At that moment, the saw tool can advance no farther into the blocking bar 3.

FIG. 3 shows the relative positions of the blocking bar 3 and the hollow security rod 11 in the final state of assembly, i.e., in the state when the two terminal latch lock mechanisms are latched. The latch lock mechanism may have a customary design and may engage the blocking bar 3 in a great variety of functional ways. One possible variant of an advantageous receiver for a latch lock is shown in FIGS. 5–7 and, in the assembled state in FIG. 10. To this end, there is provided a closure body 12 which closes off one end of the blocking bar and whose form is adapted to the inside crossection of the blocking bar 3, thereby completely sealing the blocking bar 3. This seal may even be a hermetic seal which makes it possible to fill the inside of the blocking bar 3 with a lubricant. Due to its form, the closure body 12 is in co-rotational relation with the blocking bar 3. The connection between the blocking bar 3 and the closure body 12 is secure against sliding displacement due to the presence of the latch elements 13 (see FIG. 10) which are guided to slide within a bore 14 of the closure body 12 and which extend through a bore 16 of the blocking bar 3, urged, for example, by a compression spring 15. Of course, it is possible to substitute another structural solution for this customary latch lock mechanism, provided that it would guarantee a reliable latching engagement of the latch elements 13.

On the side facing the hollow security rod 11, the closure body 12 has a machined tip 17 which makes opposing contact with the end face 18 of the hollow rod 11. Preferably, the machined tip 17 completely covers the inside of the hollow rod 11 and, if necessary, an additional shoulder may be provided at the outer face end of the tip 17.

FIG. 4 further shows that the prismatic internal shape of the blocking bar 3 (the void in the blocking bar 3 of FIG. 4 against has a square crossection) and the suitable shaping of the hollow rod 11 cause the creation of several hollow guide spaces 19 between the rod 11 and the inside surface of the blocking bar 3, in which easily rotatable steel roller cores 20 are or may be received. On each side of the hollow rod 11, the steel roller cores 20 extend from its end face 18 by an amount $T_{20}$ substantially equal to the measure $T_{17}$ of the machined tip 17 or slightly smaller. This disposition makes it possible to let the steel roller cores 20 extend relatively far over the end faces 18 of the hollow rod 11 and insure, at the same time, that the hollow guide spaces 19 can be sealed hermetically with a relatively small effort of construction. The components shown in FIGS. 3 to 7 together with the latch elements 13 supported on one another via the spring 15 may be composed into a pre-assembly which only needs to be pushed into the fixedly mounted attachment base 5.

Figure 9:
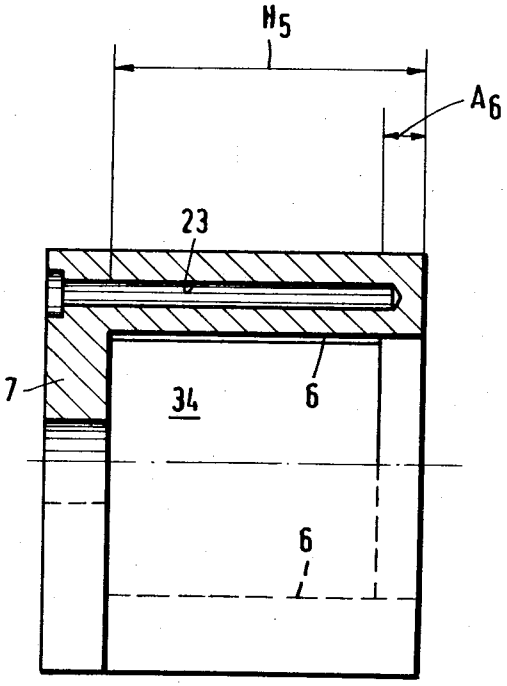
FIG. 9 is a sectional view of the attachment base shown in FIG. 8 when sectioned along the line IX—IX in FIG. 8.
Figure 8:
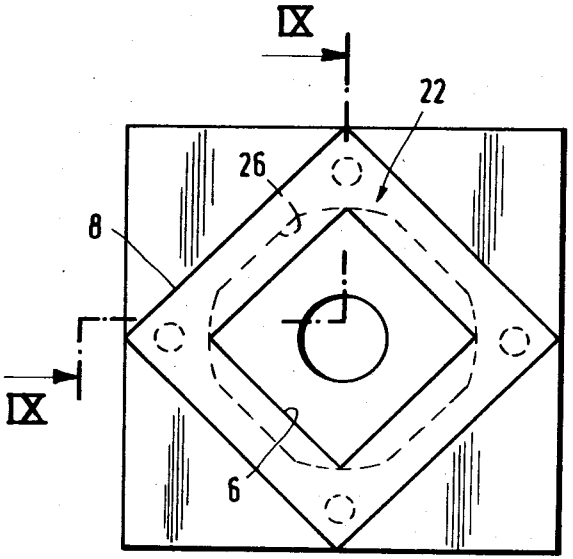
FIG. 8 is a front view of an embodiment of the attachment base of the blocking bar.
Figure 10:
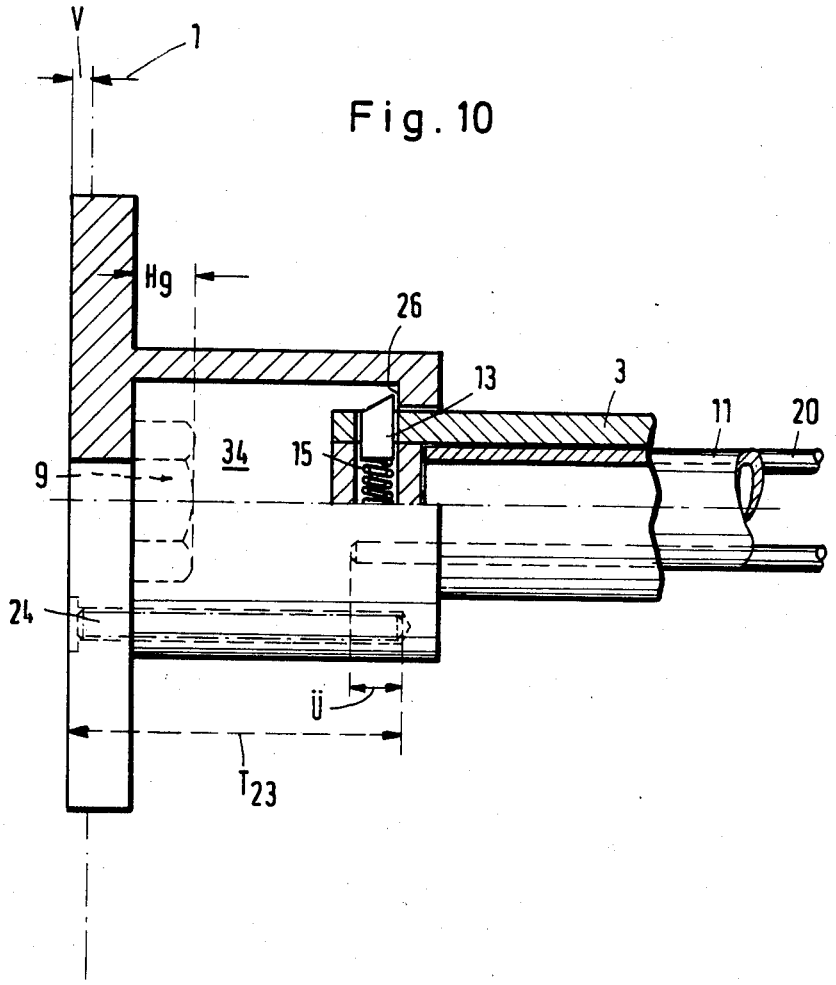
FIG. 10 is a partially sectioned overall view of the entire apparatus in its assembled state, only one anchoring point of the blocking bar being shown.

Hereinbelow will be described an advantageous embodiment of the attachment base 5. The base 5 may be produced either as a welding or a casting. The embodiment shown in FIGS. 8, 9 and 10 represents a casting but it could also be produced as a welding of substantially identical form. The prismatic tube section 8 is a boss which extends from the base plate 7. The plate 7 has a central recess or opening 6 which extends along a certain axial extent $A_6$, and has a polygonal prismatic form which is adapted to the blocking bar 3. A square opening 6 is provided to receive the blocking bar 3 shown in FIGS. 3 and 4.

For the case that the attachment base is a welding, three elements are welded together, namely a base plate 7' which is to be pressed against the wall of the shaft by means of the mounting bolt, a prismatic tubular section 8' and an aperture plate of thickness $A_6$ which covers the section 8' on the side facing the blocking bar 3.

The length or, if applicable, the height $H_5$ of the attachment base 5 is so chosen or adapted to the height $H_9$ of the head of the bolt 9 that, when the blocking bar 3 is assembled and installed, the security rod 11 is located radially within the attachment base 5.

When the attachment base 5 is a casting, it is especially advantageous to create an accumulation of material in the region of the corners 22 of the tube receiver boss 8 and to provide a blind bore 23 in the axial direction starting at the anchor foot 7. The depth $T_{23}$ of the blind bore 23 should be as large as possible in order to insure that it will overlap axially with the steel roller cores 20. As indicated schematically in FIG. 10, steel roller pins 24 capable of free rotation in the blind bores 23 are inserted therein. To insure this rotational ability even after prolonged times of use of the anti-intrusion device, the blind bore 23 may be filled with a suitable lubricant and thereafter sealed hermetically or watertight with a plug.

FIG. 10 shows that the above-described embodiment of the closure element 12 makes it possible to easily create an axial overlapping ü as between the steel roller pins or latch bodies 24 and the steel roller cores 20. Thus, neither the attachment base 5 nor the blocking bar 3 can be severed radially.

Figure 11:
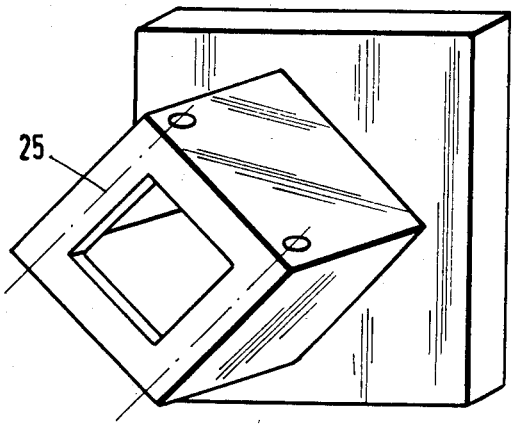
FIG. 11 is a perspective view of a further development of the attachment base shown in FIGS. 8 and 9.

In order to effectively hinder sawing through the attachment base 5 in an axial direction, further blind bores 25 may be provided (as shown in FIG. 11) and they serve to receive easily rotating steel roller cores in the same way as the blind bore 23.

The apparatus according to the invention is installed in such a way that, initially, the anchoring base 5 is attached to the wall 1 of the shaft, preferably in somewhat countersunk fashion (see also FIG. 10) and that, thereafter, the blocking bar 3, together with the hollow rod 11, and, if applicable, with the steel roller cores 20 and the closure member 12 and the latch lock are combined into an assembly unit which is then introduced into one of the attachment bases to an extent that the other end of the blocking bar 3 lies in front of the inside end face of the other attachment base 5 and which, in this aligned position of the blocking bar 3 and the recess 6, is introduced so far into the other attachment base 5 that the latch bodies 13 snap into an undercut relief 26 (see FIGS. 8 and 10) as urged by spring force. Due to the fact that the attachment bases 5 are countersunk to a measure V within the shaft wall 1, the attachment base cannot be severed even at its extreme end, i.e. in the region of the closure plug, by any saw or other severing tool.

FIGS. 12 to 18 show various variants of the crossectional composition of the intrusion protection in the region of the blocking bar. In all these cases, a blocking bar 3 having a square crossection is used. Of course, these variants can also be used in conjunction with another form of blocking bar.

Figure 12:
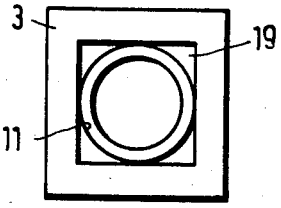
FIGS. 12–18 are view similar to that of FIG. 4 of a number of variants of blocking bar security devices.

The blocking bar 3 of FIG. 12 holds only a single hollow security rod 11 in the form of a round tube. In this variant, the voids 19 are vacant. The blocking bar 3 is preferably made of zinc-coated steel and the hollow security rod 11 is formed from a zinc-coated, tempered steel tube.

Figure 13:
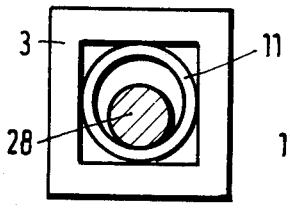

The variant of FIG. 13 differs from that of FIG. 12 only in that an additional steel core 28 is inserted into the interior of the hollow rod 11 and that its basic material is different from that of the hollow rod 11 and/or of the blocking bar 3. In this way it is possible to insure that, when a cutting burner is used for forcing the anti-intrusion device, hindering chemical reactions will occur that prevent severing. In order to avoid the effects of contact corrosion, it is advantageous to coat the tempered steel core 28 and the inside surface of the hollow rod 11.

Figure 14:
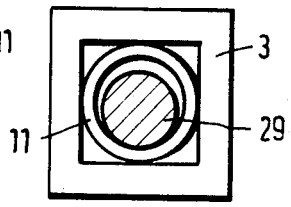
Figure 15:
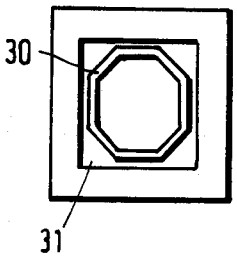

The embodiment of FIG. 14 differs from that of FIG. 13 only in that the steel core 28 has been replaced by a plastic core 29. The composition of this plastic is suitably so chosen that, under thermal influence, for example by a cutting burner, a smoke pillar and/or explosive puffing effects occur which are enhanced by the fact that the ends of the hollow rod 11 and of the blocking bar 3 are completely sealed.

Of course, the variants according to FIGS. 12–14 can also be equipped with the steel roller cores 20.

The embodiments according to FIGS. 15 to 18 operate with an octagonal hollow rod 30 instead of a round rod 11. It will be seen from the illustrations that the voids 31 remaining in the corners between the prismatic rod 30 and the blocking bar 3 can be used especially well for receiving steel roller cores 20 because the wedge angle $\varkappa$ of the void 31 is somewhat larger in this case and the jamming of the steel roller core 20 is prevented with even greater assurance.

Figure 16:
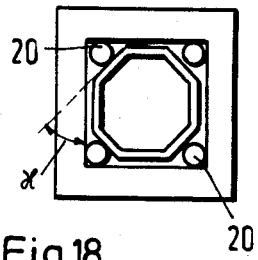
Figure 17:
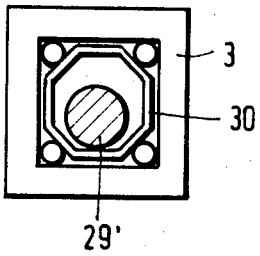

The embodiment of FIG. 17 differs from that of FIG. 16 only in that a plastic core 29' is again placed within the hollow rod 30.

Figure 18:
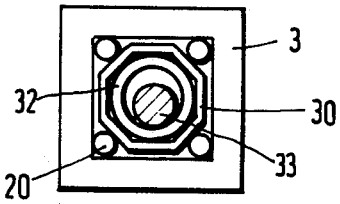

In the embodiment of FIG. 18, a further steel security rod 32 is additionally placed within the octagonal hollow rod 30 and can rotate freely and easily therewithin.

Either a plastic or steel core 33 is then received within this additional steel security rod 32.

The embodiments according to FIGS. 15 to 18 are also subject to the rule that metal surfaces in contact with one another are preferably made of the same material in order to avoid contact corrosion effects.

It has already been mentioned above that the latch lock mechanism according to the invention is so constructed that, even when the highest of temperatures prevail, the spring effect of the compression spring is not negated. For additional security of the latch elements, it would be possible to use a variant of the embodiment described, namely a latch pre-tensioning device which expands somewhat under the influence of high temperatures and by which the latch elements are pushed outwardly into the undercut recess 26 with ever-increasing force.

It should be pointed out further that the safeguarding of the attachment base 5 by means of the steel roller pins 24 is not only feasible if the attachment base is a casting. It is obvious that the steel roller pins 24 can also be mounted in the attachment base 5 so as to be held only at their ends in aligned bearing holes. In this case too, the co-rotation of the steel roller pins should be assured, especially if it is taken into account that the inside void 34 (see FIGS. 9 and 10) is closed to the outside in water-tight manner by a suitably constructed attachment dowel for the bolt 9.

The installation of the blocking bars 3 can also take place differently than shown in the figures, namely in that the axes 10 make a certain angle, for example 45°, with the axis 2 of the shaft and/or with the surfaces of the shaft wall.

When the installation is complete, preferably all fitted surfaces of the device are sealed from the outside with a sealant that remains effective for a long time.

The attachment base can also be varied within a wide frame depending on the conditions of the building being considered. This is explained with the aid of the embodiment according to FIG. *2a*. According to this variant, the attachment base 5″ is not mounted on the inside wall 1 but on the opening 100 of a window shaft. Accordingly, the base plate 7″ carries the prismatic tube section 8″ in such way that the latter is parallel to the plane of the base plate 7″. The base plate 7″ or, for the case of a casting, the attachment foot 7′, again has a recess for a mounting bolt 9 which, in the installed state, is covered directly or by alignment by the eds 4, 4′ of the blocking bar. In this variant, care must be taken that the head of the mounting bolt 9 does not extend into the crossection needed by the ends 4, 4′ of the blocking bar.

The tightening of the mounting bolt may be performed again by any suitable tool from the outside through the opening in the tube section 8″. For the remainder, this base is secured in the same way as already set forth above in connection with the other figures.

Accordingly, the invention provides an apparatus for securing the shafts of buildings, especially light shafts, against forcible entry or passage. The apparatus includes at least one hollow blocking bar which spans the shaft transversely and both ends of the bar are held in an anchor member mounted on the wall of the shaft with covered bolts. The bar receives within it a hollow security rod of substantially the same length. The blocking bar has the form of a polygonal prism the ends of which are received in form-fitting manner in respective openings of an associated attachment base in such a way that they are in aligned opposition to the mounting bolts of the base and are secured against pull-out by a latch lock mechanism. The new apparatus is distinguished especially in that it offers a maximum of security against forcible intrusion for a very low expenditure of technical and installation effort by giving access to the mounting bolts only when all of the blocking bars have been removed and wherein the special shape of the blocking bars makes a positive contribution to maintaining the functional security of the components taking part in the anti-intrusion device as long as possible.

Various modifications in structure and/or function may be made to the disclosed embodiments by one skilled in the art without departing from the scope of the invention as defined by the claims.

What is claimed is:

1. An apparatus for securing an access in a building wall against passage or entry comprising:

at least one hollow blocking bar having a polygonal internal and external cross-section and which extends across the access, the bar having ends fixed to respective anchor members attached by mounting means to the wall, a security rod disposed within the bar and having substantially the same axial length as the bar, the rod having a polygonal cross-section different from the internal cross-section of the bar, each anchor member comprising a boss structurally integral with a base plate, the boss having an opening for receiving respective ends of the bar, the opening having a polygonal cross-section corresponding to the external cross-section of the bar so as to engage the bar, the mounting means being substantially opposite to and spaced from the ends of the bar and securing the base plate to the wall, and lock means for preventing the removal of the bar ends from the opening, the lock means comprising a closure body at the ends of and closely fitted within the bar, the closure body having a diametrically extending bore, a pair of latch bodies disposed in the bore, each latch body extending through the bar and engaging the anchor member, a spring means disposed in the bore beween the latch bodies for supporting the latch bodies, the closure body having a tip on a side facing the security rod, which tip does not extend radially beyond the rod.

2. The apparatus of claim 1 wherein easily rotating roller cores are contained in voids remaining between the inside surface of the blocking bar and the security rod, the roller cores extending substantially for the length of the voids.

3. The apparatus of claim 2, wherein the ends of roller cores (20) lie in voids (19; 31) that remain between the respective tip (17) and the inside surface of the blocking bar (3).

4. The apparatus according to claim 1, wherein the base plate (5) has substantially the outside shape of a polygonal prism.

5. The apparatus of claim 4 wherein the anchor member is formed by three parts welded together, comprising the base plate, the boss and an aperture plate which covers the boss on the side facing the blocking bar and which includes the opening that is adapted to be cross-section of the bar.

6. The apparatus of claim 1 wherein the lock means snaps into the opening when installed.

7. The apparatus of claim 4 wherein the anchor member is a casting member comprising the boss molded onto the base plate and having the opening extending up to the base plate and having a polygonal shape extending over an axial extent and adapted to the cross-section of the block bar.

8. The apparatus according to claim 1, wherein the latch body penetrates the blocking bar (3) in the region of the polygonal surfaces.

9. The apparatus according to claim 1, wherein the height or length ($H_5$) of the boss is so chosen that, in the installed state of the blocking bar (3), the security rod (11; 30) lies radially inside the attachment base (5).

10. The apparatus according to claim 1, wherein in regions of the anchor member lying radially outside of the area covered by the blocking bar (3), the attachment base (5) contains steel roller pins (24) which are carried in freely rotating manner within hermetically sealed bores (23).

11. The apparatus of claim 10, wherein several steel roller pins (24) are provided and are aligned parallel with the blocking bar (3) and substantially extend over the entire length of the anchor member to a degree that their ends remote from the wall (1) overlap axially with the steel roller cores (20) contained in the blocking bar (3).

12. The apparatus according to claim 10, wherein the steel roller pins (24) are contained in blind bores (23) that are sealed by means of closure plugs.

13. The apparatus according to claim 10, wherein the blocking bar (3) is formed from a hollow profile tube having square inside and outside contours.

14. The apparatus according to claim 13, wherein the security rod (11) is formed from a circular cylindrical tube.

15. The apparatus according to claim 13, wherein the security rod (30) is formed from an octagonal hollow rod.

16. The apparatus according to claim 13, wherein the polygonal opening (6) of the anchor member is formed by a square opening.

17. The apparatus according to claim 16, wherein the boss is so aligned in the installed state that the side surfaces of the square opening (6) make an angle of 45° with the axis (2) of the access.

18. The apparatus according to claim 16, wherein the base plate has the external form of a rectangular, preferably a square, prism, which is created by centrally extending the square opening (6).

19. The apparatus according to claim 1, wherein a steel core (28) is contained in the security rod (11; 30).

20. The apparatus according to claim 1, wherein a plastic core (29; 29') is contained within the security rod (11; 30).

21. The apparatus according to claim 1, wherein a further steel security tube (32) is contained within the security rod (30).

22. The apparatus according to claim 21, wherein a plastic core (33) is placed in the steel security rod (32).

23. The apparatus according to claim 1, wherein the blocking bar (3) is formed by a zinc-coated steel tube and in that the security rod (11; 30) is also zinc-coated.

24. The apparatus according to claim 1, wherein the anchor member consists of tempered steel or of very tough cast steel.

25. The apparatus according to claim 1, wherein a void (34) within the anchor member between the mounting means and the closure body (12) is sealed hermetically with respect to the outside.

26. The apparatus according to claim 1 wherein a plurality of bosses are disposed on a common base plate which, in turn, is anchored on the wall by mounting means.

27. The apparatus according to claim 19, wherein the basic material of the steel core (28; 33) is different from that of the security rod (11; 32).

28. The apparatus according to claim 1, wherein the basic material of the security rod (11; 30) is different from that of the blocking bar (3).

29. The apparatus according to claim 2, wherein the steel roller cores (2) consist of tempered and/or forged steel with a zinc-coated surface.

30. The apparatus according to claim 1, wherein the hollow security rod (11; 30) consists of zinc-coated and tempered steel.

31. The apparatus according to claim 1, wherein the closure body (12) consists of zinc-coated steel.

32. The apparatus according to claim 1, wherein the faces of the ends (4) of the blocking bar (3) lie opposite the mounting means.

33. The apparatus according to claim 1, wherein outside surfaces of the ends (4) of the blocking bar (3) lie opposite the mounting means.

* * * * *